US007171833B1

(12) United States Patent
Wu

(10) Patent No.: US 7,171,833 B1
(45) Date of Patent: Feb. 6, 2007

(54) CYLINDER LOCK

(76) Inventor: Kun-Yu Wu, No. 69-92, Sinshu Rd., Sinjhuang City, Taipei Hsien (TW)

( * ) Notice: Subject to any disclaimer, the term of this patent is extended or adjusted under 35 U.S.C. 154(b) by 0 days.

(21) Appl. No.: 11/350,817

(22) Filed: Feb. 10, 2006

(51) Int. Cl.
*E05B 27/08* (2006.01)

(52) U.S. Cl. ..... 70/491; 70/360

(58) Field of Classification Search ..... 70/360, 70/403, 404, 419, 491, 496
See application file for complete search history.

(56) References Cited

U.S. PATENT DOCUMENTS

| | | | | |
|---|---|---|---|---|
| 2,226,355 | A * | 12/1940 | Hofmann | 70/491 |
| 3,524,335 | A * | 8/1970 | George | 70/491 |
| 3,878,700 | A * | 4/1975 | Lopez | 70/491 |
| 4,683,739 | A * | 8/1987 | Hughes | 70/365 |
| 5,133,203 | A | 7/1992 | Huang | 70/360 |
| 5,447,049 | A * | 9/1995 | Shieh | 70/360 |
| 5,720,191 | A * | 2/1998 | Tsung-Chuan et al. | 70/38 A |
| 6,523,378 | B2 * | 2/2003 | Kuo | 70/360 |
| 6,904,775 | B2 * | 6/2005 | Makos et al. | 70/16 |
| 2006/0096344 | A1 * | 5/2006 | Lee | 70/491 |

* cited by examiner

*Primary Examiner*—Lloyd A. Gall
(74) *Attorney, Agent, or Firm*—Troxell Law Office, PLLC

(57) ABSTRACT

The cylinder lock has a housing, a fixed hollow cylinder, a rotatable hollow cylinder and a locking bar. The locking bar has a mounting portion with planes, shoulders and a resilient element mounted around the mounting portion. The rotatable hollow cylinder has a non-circular mounting hole corresponding to and held slidably the mounting portion of the locking bar to enable synchronous rotation and relative sliding movement of the rotatable hollow cylinder and the locking bar to make the cylinder lock active. By the modification of the locking bar and the rotatable hollow cylinder, the structure of the cylinder lock is effectively simplified and the fabrication of the cylinder lock is easy.

2 Claims, 8 Drawing Sheets

CYLINDER LOCK

BACKGROUND OF THE INVENTION

1. Field of the Invention

The present invention relates to a lock, more particularly to a cylinder lock with a simplified structure.

2. Description of Related Art

Locks are widely used and have been developed into different types for different purposes, for example a cylinder lock as shown in FIGS. 9 and 10. The cylinder lock tends to lock without using a key and includes a tubular housing (90), a fixed hollow cylinder (60), a rotatable hollow cylinder (80) and a locking bar (70).

The fixed hollow cylinder (60) has an end surface, a spring-loaded retaining element (61) disposed in the fixed hollow cylinder (60) and multiple bores (62) formed in the end surface. Each of the bores (62) has a tumbler pin (621) and a tumbler spring (620) held inside.

The rotatable hollow cylinder (80) has multiple holes (81) formed longitudinally through the rotatable hollow cylinder (80). Each of the holes (81) has a bolt (810) held inside.

The locking bar (70) is mounted through the rotatable hollow cylinder (80) and the fixed hollow cylinder (60) coaxially in the housing (90) and has an outer surface, a latching end, an actuated end, a guide pin (71), a resilient element (74), a slot (73) and a positioning hole (72) formed on the outer surface. The guide pin (71) is mounted securely on the rotatable hollow cylinder (80) and received slidably in the slot (73) in the locking bar (70) so as to enable synchronous rotation and relative sliding movement of the rotatable hollow cylinder (80) and the locking bar (70). The resilient element (74) is mounted in the locking bar (70), which is retained by the guide pin (71) and biases the actuated end of the locking bar (70).

The actuated end of the locking bar (70) can be pushed to move inward to make the latching end of the locking bar (70) extends out from the housing (90). When the latching end extends to a predetermined distance, the retaining element (61) engages with the positioning hole (72) of the locking bar (70) so as to locate the locking bar (70) in a locked position.

Certainly, the cylinder lock aforementioned is able to lock without using a key. However, with such a complicated structure of the conventional cylinder lock, the fabrication of the cylinder lock is difficult and costly.

To overcome the shortcomings, the present invention provides a cylinder lock to obviate or mitigate the aforementioned problems.

SUMMARY OF THE INVENTION

The objective of this invention is to provide a compact cylinder lock with a simplified structure.

The cylinder lock comprises a housing, a fixed hollow cylinder, a rotatable hollow cylinder and a locking bar.

Wherein the housing and the fixed hollow cylinder are similar with those in the aforementioned conventional cylinder lock.

The locking bar has a latching end, an actuated end, a mounting portion, a resilient element and a fixing element.

The mounting portion is formed near the actuated end and has a surface, at least one tangent plane formed on the surface and at least one shoulder defined on each tangent plane. The resilient element is coaxially put around the mounting portion. The fixing element can be fixed onto the actuated end of the locking bar to retain the resilient element securely.

The rotatable hollow cylinder has a center and a non-circular mounting hole formed in the center corresponding and engaged slidably to the mounting portion of the locking bar so as to enable synchronous rotation and relative sliding movement of the rotatable hollow cylinder and the locking bar.

The actuated end of the locking bar can be pushed to move inward to make the latching end of the locking bar extends from the housing. When the latching end extends to a predetermined distance, the fixed hollow cylinder has a retaining element engages with the shoulder of the locking bar so as to locate the locking bar in a locked position. Moreover, the latching end can be pulled by the compressed resilient element to return to an unlocked position by insertion and rotation of an associated key.

By the modification of the locking bar and the rotatable hollow cylinder, the structures of the cylinder lock in accordance with the present invention can effectively be simplified and the fabrication would become easier.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
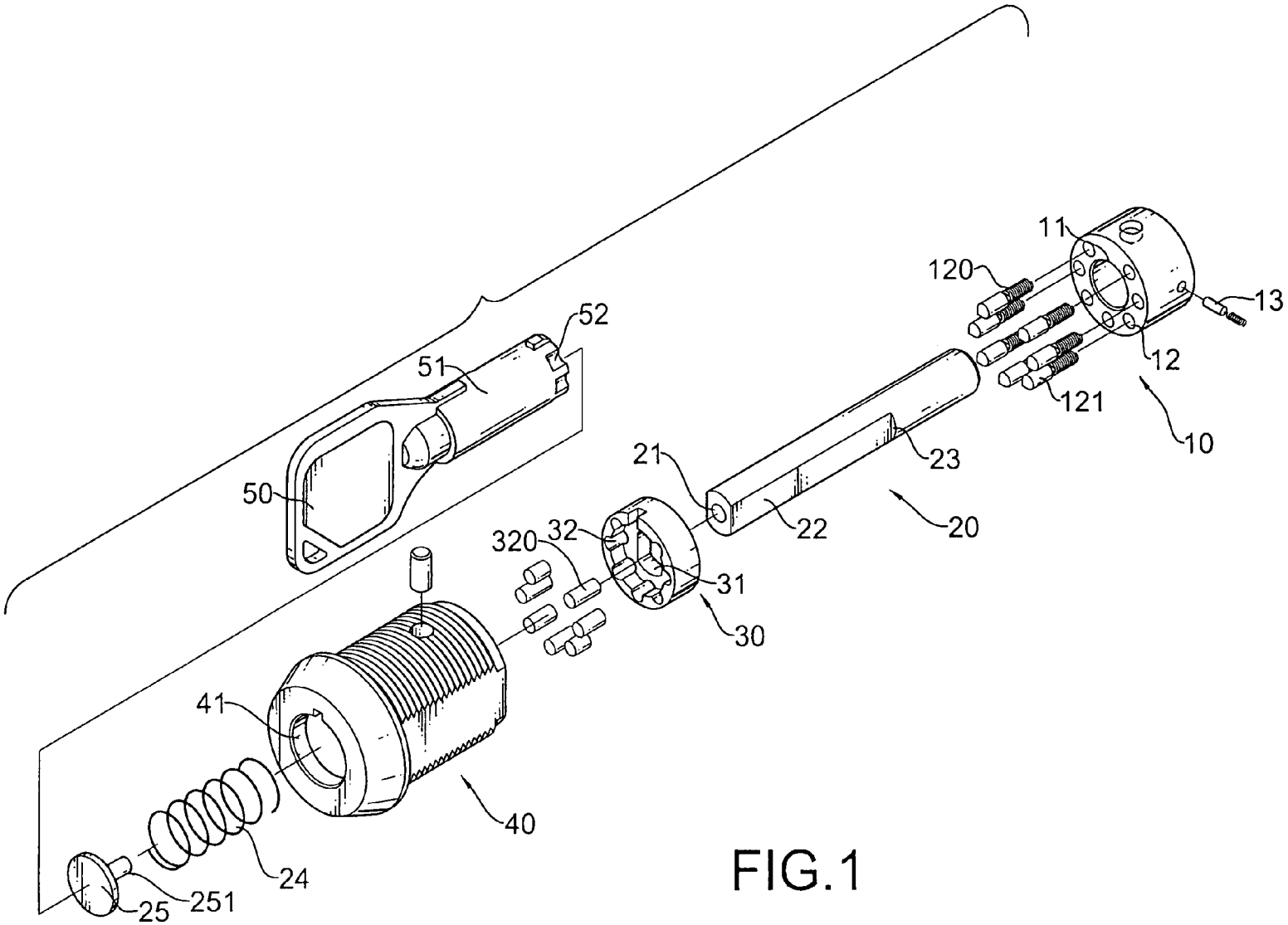
FIG. 1 is an exploded perspective view of the cylinder lock in accordance with the present invention.
Figure 2:
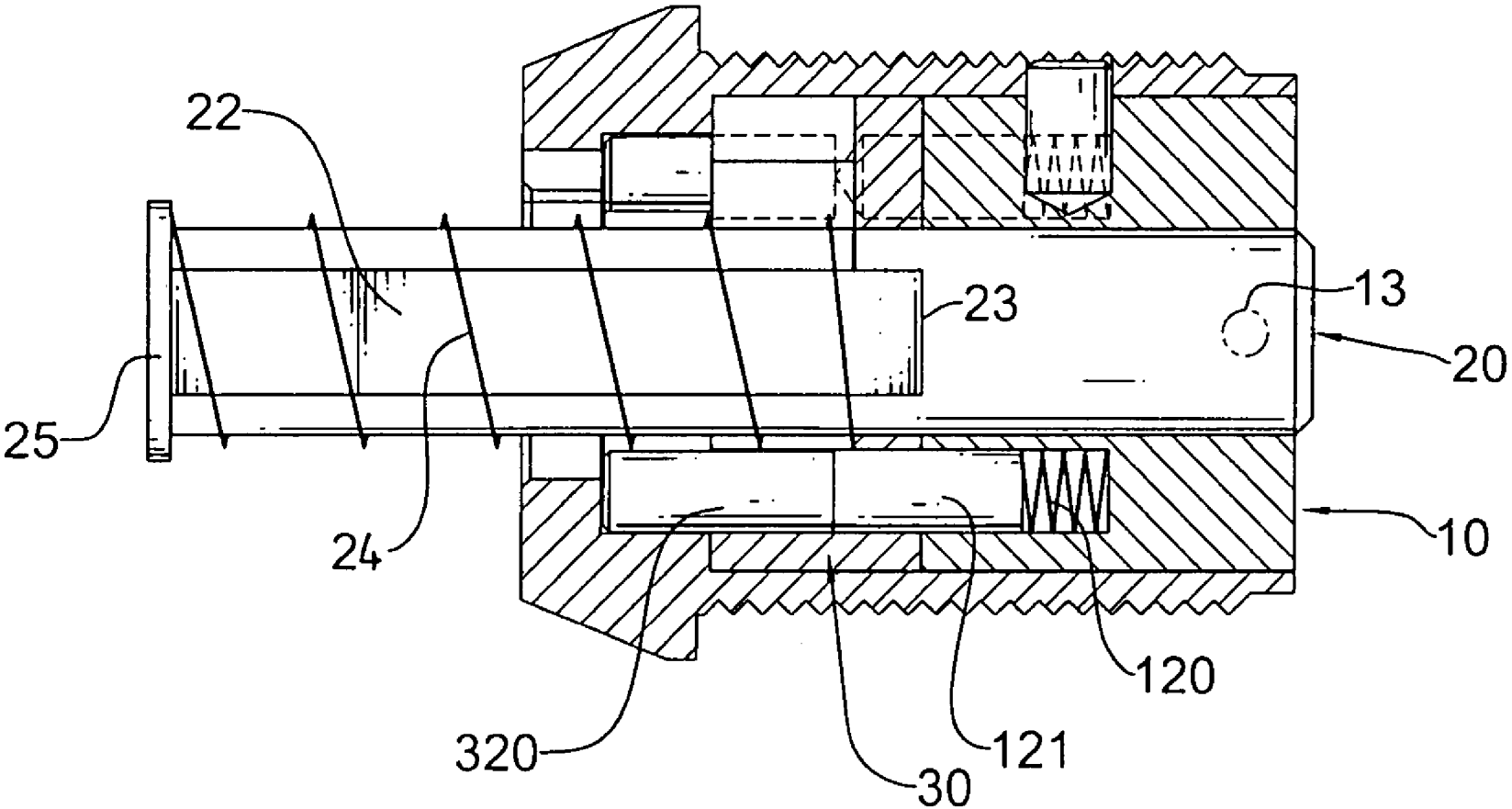
FIG. 2 is a side view in partial cross section of the cylinder lock in of FIG. 1 in an unlocked position.

With reference to FIGS. 1 and 2, a cylinder lock in accordance with the present invention includes a tubular housing (40), a fixed hollow cylinder (10), a rotatable hollow cylinder (30) and a locking bar (20).

The housing (40) is hollow and has a flanged end and a key hole (41) defined in the flanged end.

The fixed hollow cylinder (10) is securely held inside the housing (40) and has an end surface, a center hole (11), a spring-loaded retaining element (13) disposed in the fixed hollow cylinder (10) and multiple bores (12) formed in the end surface. Each of the bores (12) has a tumbler pin (121) and a tumbler spring (120) held inside. The tumbler pins (121) is pushed by the tumbler springs (120).

The rotatable hollow cylinder (30) is coaxially mounted with the fixed hollow cylinder (10) in the housing (40) and has a center, a non-circular mounting hole (31) formed in the center and multiple holes (32) formed longitudinally through the rotatable hollow cylinder (30). Each of the holes (32) has a bolt (320) corresponding and pushed by one of the tumbler pins (121).

The locking bar (20) extends through the center hole (11) in the fixed hollow cylinder (10), the mounting hole (31) in the rotatable hollow cylinder (30) and the key hole (41) in the housing (40) and has a latching end, an actuated end, a mounting portion (22), a resilient element (24) and a fixing element (25).

The actuated end has a fixing hole (21), which corresponds to and is mounted in the center hole (11) in the fixed hollow cylinder (10). The mounting portion (22) is formed near the actuated end and has a surface, two planes oppositely formed on the surface and two shoulders (23) defined respectively on the planes to buckle with the retaining element (13). The mounting portion (22) extends slidably through the non-circular mounting hole (31) in the rotatable hollow cylinder (30) so as to enable synchronous rotation and relative sliding movement of the rotatable hollow cylinder (30) and the locking bar (20). The resilient element (24) is mounted around the mounting portion (22). The fixing element (25) has a protrusion (251) inserted into the fixing hole (21) of the locking bar (20) and retaining the resilient element (24) securely.

A key (50) has a tubular operating portion (51), which is formed with multiple key cutouts (52) in different sizes. The sizes of the key cutouts (52) are determined based on the positions and lengths of the bolts (320).

Figure 3:
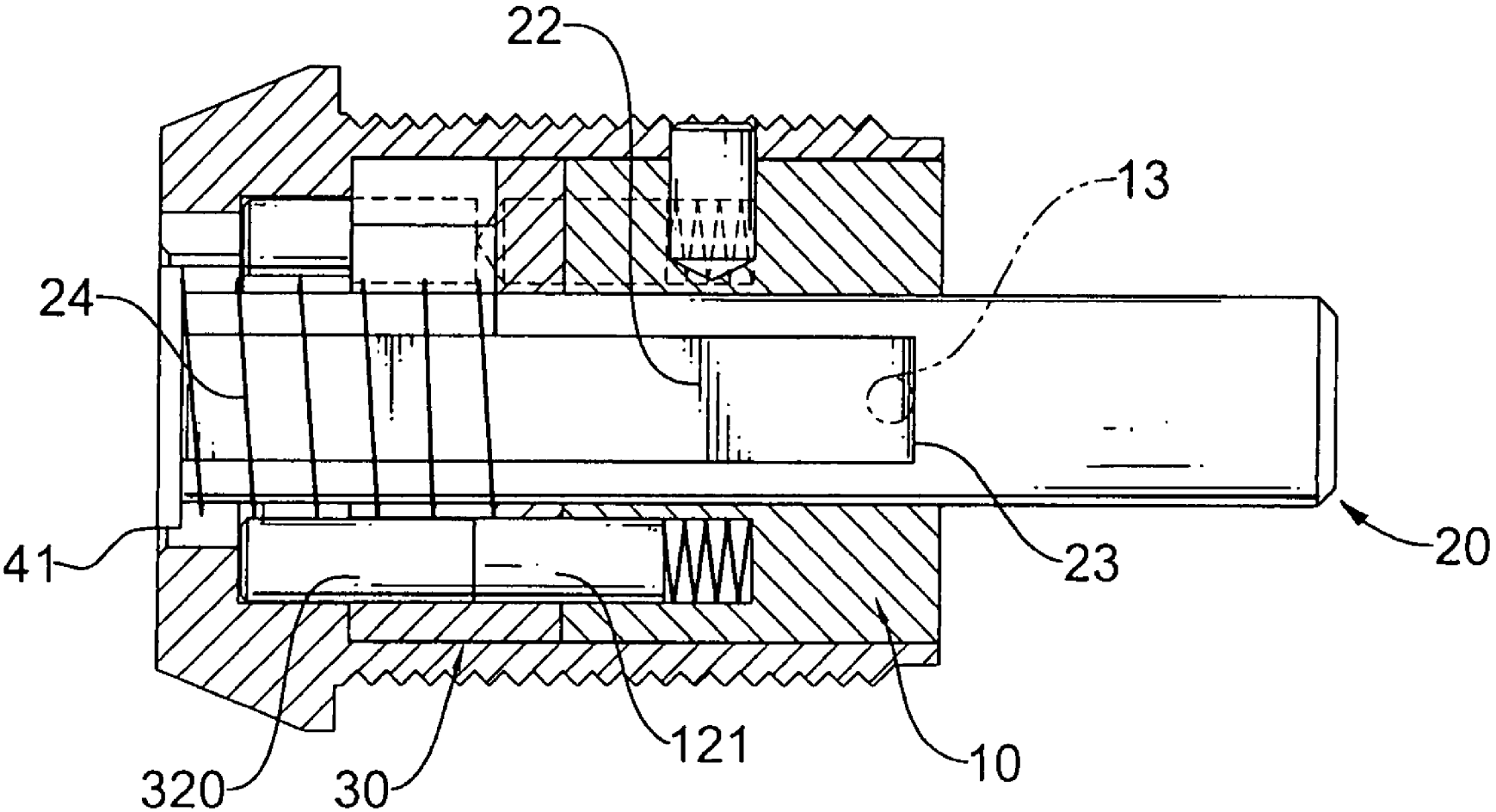
FIG. 3 is a side view in partial cross section of the cylinder lock of FIG. 1 in a locked position.
Figure 4:
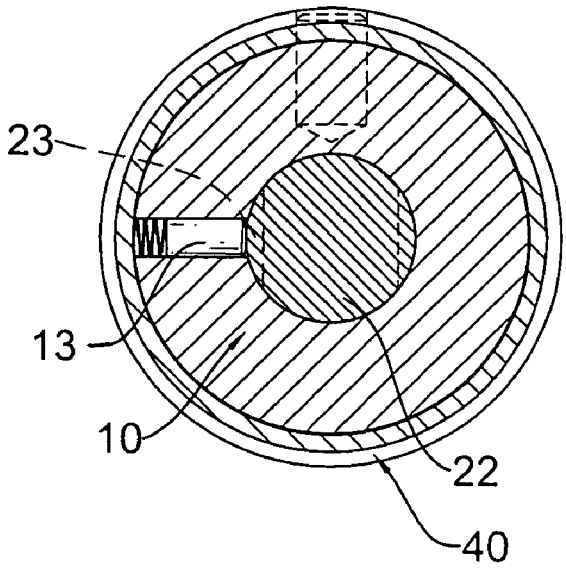
FIG. 4 is a end view in partial cross section of the cylinder lock in FIG. 1 showing the movement of the retaining element when the cylinder lock is locked.
Figure 5:
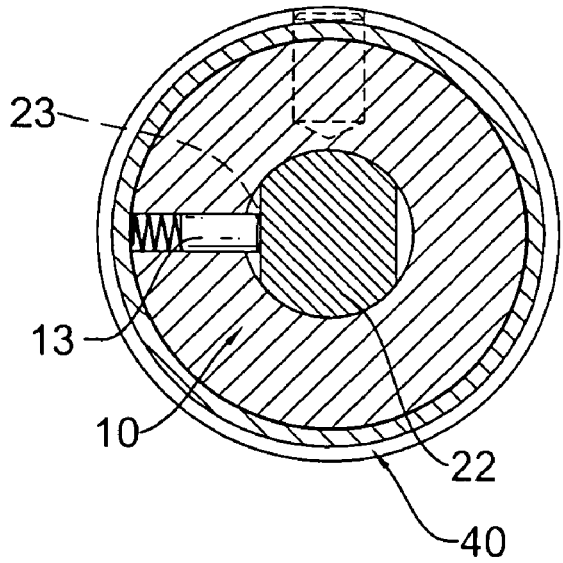
FIG. 5 is an operational end view in partial cross section of the cylinder lock in FIG. 1 showing the movement of the retaining element when the cylinder lock is locked.

With further reference to FIGS. 3, 4 and 5, the actuated end of the locking bar (20) can be pushed to move inward the housing (40) to make the latching end of the locking bar (20) extends out from the housing (40). When the latching end extends to a predetermined distance, the retaining element (13) can engage with the shoulder (23) in a corresponding plane (22). With the engagement between the retaining element (13) and the corresponding shoulder (23), the locking bar (20) is kept from moving backward so as to hold the locking bar (20) in a locked position.

Figure 6:
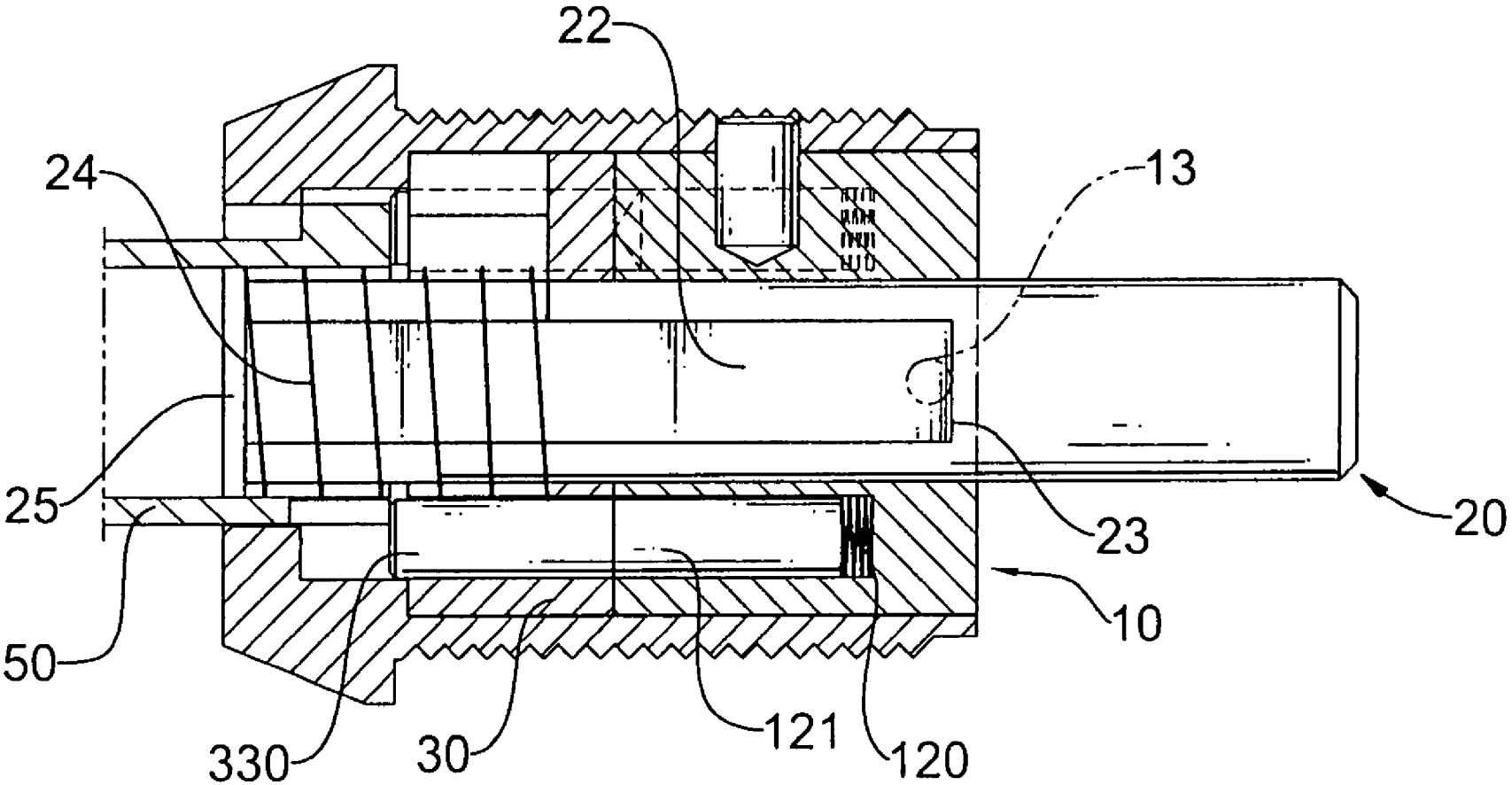
FIG. 6 is an optional side view in partial cross section of the cylinder lock in FIG. 1 showing that an associated key is inserted into the cylinder lock.
Figure 7:
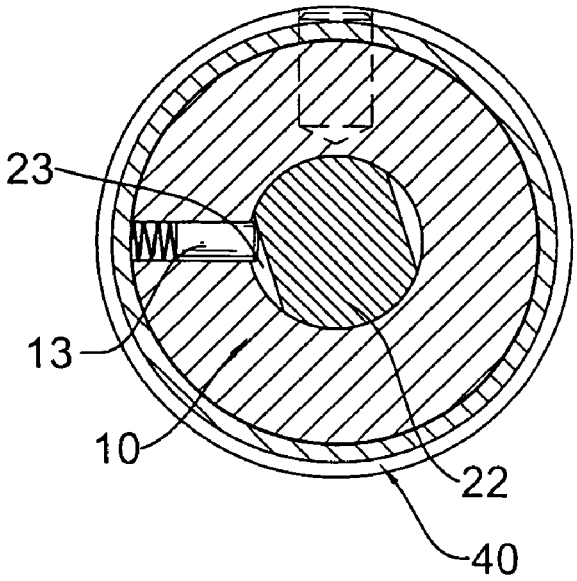
FIG. 7 is a end view in partial cross section of the cylinder lock in FIG. 1 showing the movement of the retaining element when the cylinder lock is unlocked.
Figure 8:
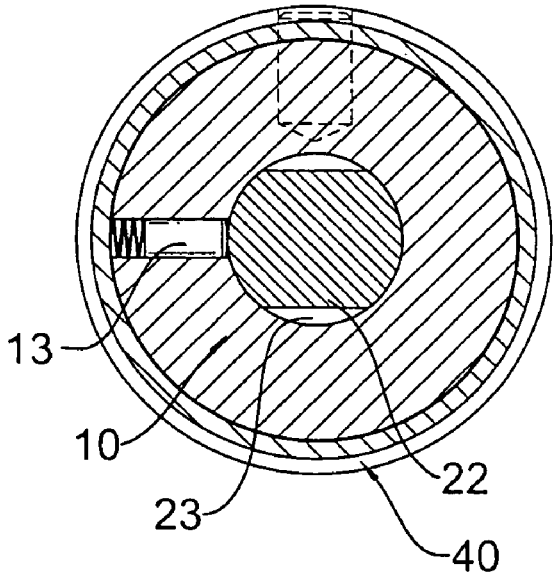
FIG. 8 is an operational end view in partial cross section of cylinder lock in FIG. 1 showing the movement of the retaining element when the cylinder lock is unlocked.
Figure 9:
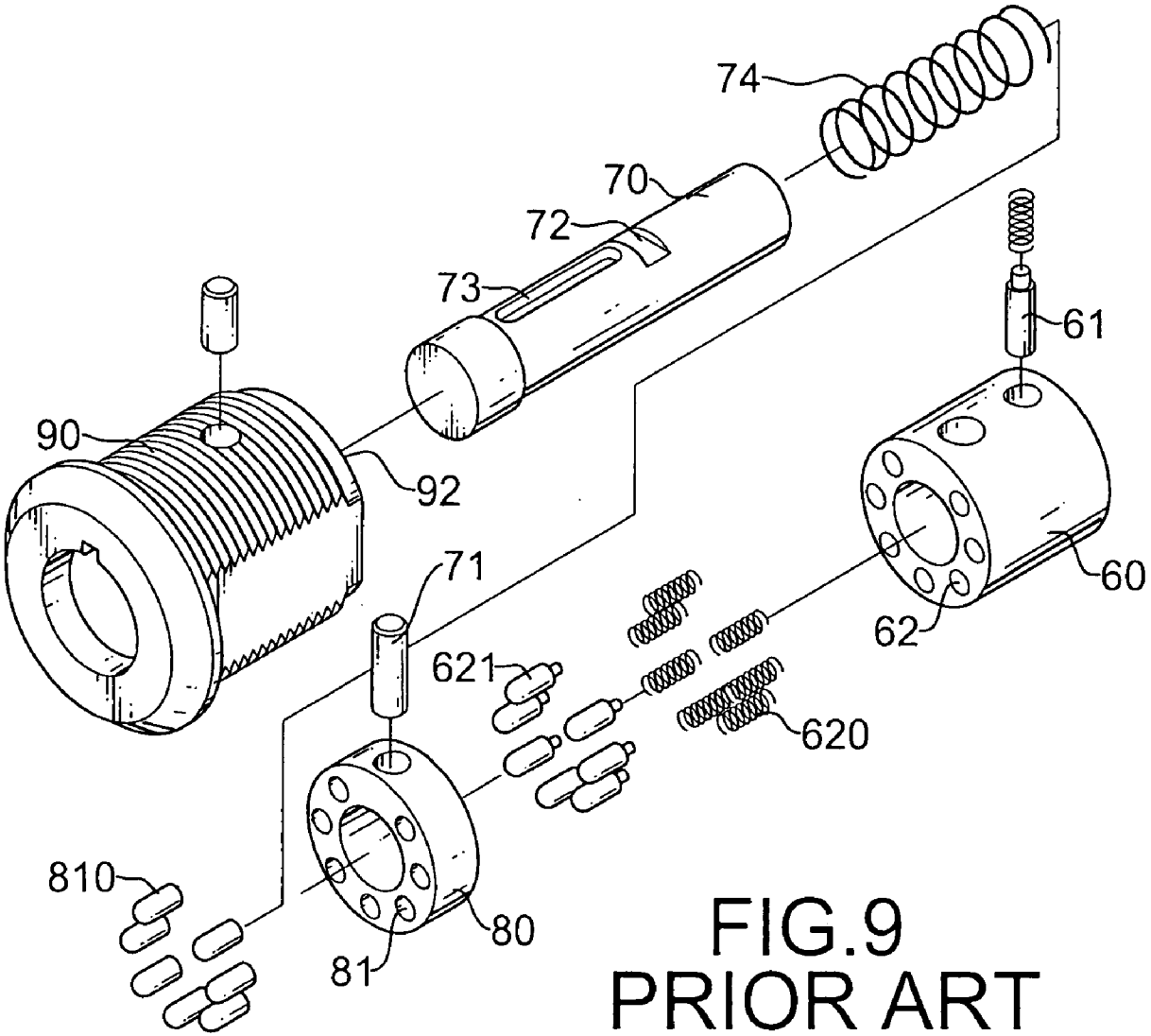
FIG.9 PRIOR ART
FIG. 9 is an exploded perspective view of a conventional cylinder lock in accordance with the prior art.
Figure 10:
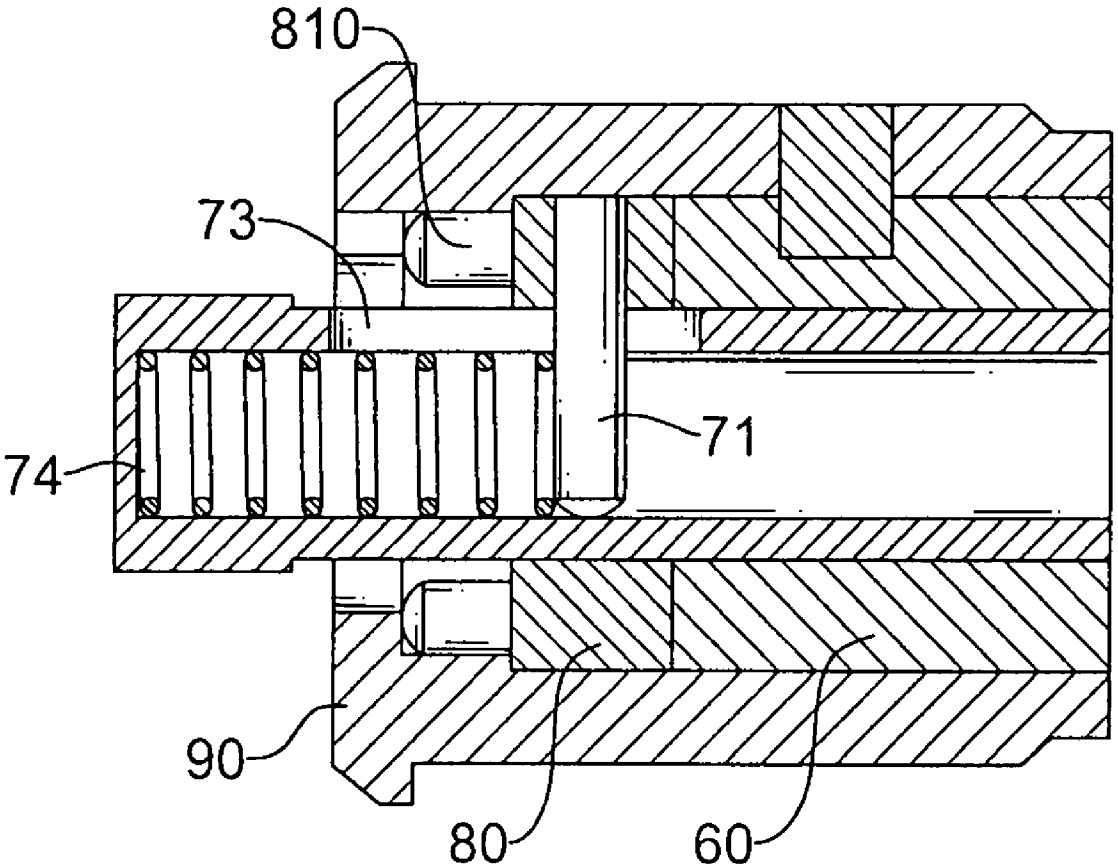
FIG. 10 PRIOR ART
FIG. 10 is a side view in partial cross section of the conventional cylinder lock in FIG. 9.

With further reference to FIGS. 6, 7 and 8, when an associated key (50) is inserted into the key hole (41) and holds around the actuated end of the locking bar (20), the bolts will engage respectively with and be pushed by the key cutouts (52). Consequently, the bolts (320) and the tumbler pins (121) are pushed to an interface between the cylinders (10,30) and are located respectively at two sides of the interface between the cylinders (10,30). Accordingly, the rotatable hollow cylinder (30) and the locking bar (20) are rotated relative to the housing (40) and the fixed hollow cylinder (10) when the key (50) is turned. While the locking bar (20) is rotating, the retaining element (13) will disengage from the corresponding shoulder (23). Thus, the actuated end of the locking bar (20) is pushed by the compressed resilient element (24) to extend out from the key hole (41), and the latching end moves into the housing (40) and the tumbler pins (121) push the bolts (320) forward to buckle up the rotatable hollow cylinder (30) and keep the locking bar (20) in an unlocked position.

With such an arrangement, the structure of the cylinder lock in accordance with the present invention can effectively be simplified and the fabrication of the cylinder lock becomes easier.

Even though numerous characteristics and advantages of the present invention have been set forth in the foregoing description together with details of the structure and function of the invention, the disclosure is illustrative only. Changes may be made in detail especially in matters of shape, size, and arrangement of parts within the principles of the invention to the full extent indicated by the broad general meaning of the terms in which the appended claims are expressed.

What is claimed is:

1. A cylinder lock comprising:

a tubular housing being hollow and having a flanged end and a key hole defined in the flanged end;

a fixed hollow cylinder securely held inside the housing and having an end surface;

a center hole;

a spring-loaded retaining element disposed in the fixed hollow cylinder;

multiple bores formed in the end surface; and multiple tumbler pins and tumbler springs mounted in the bores respectively;

a rotatable hollow cylinder being coaxially mounted with the fixed hollow cylinder in the housing and having a center;

a non-circular mounting hole formed in the center; and multiple holes formed longitudinally through the rotatable hollow cylinder, each of the holes having a bolt corresponding to and pushed by one of the tumbler pins;

a locking bar extending through the center hole in the fixed hollow cylinder, the mounting hole in the rotatable hollow cylinder and the key hole in the housing and having a latching end corresponding to and mounted slidably in the center hole of the fixed hollow cylinder;

an actuated end;

a mounting portion formed near the actuated end, extending slidably through the mounting hole in the rotatable hollow cylinder and having a surface;

two planes oppositely formed on the surface;

two shoulders defined respectively on the planes and selectively abutting with the retaining element;

a resilient element mounted around the mounting portion and retained by the locking bar.

2. The cylinder lock as claimed in claim 1, wherein the locking bar further has a fixing hole formed on the actuated end; and a fixing element attached to the locking bar and having a protrusion inserted into the fixing hole of the locking bar to retain the resilient element securely.

* * * * *